US007460024B1

(12) United States Patent
Ma et al.

(10) Patent No.: US 7,460,024 B1
(45) Date of Patent: Dec. 2, 2008

(54) ACTIVE SENSOR CIRCUITRY FOR OPERATING AT LOW POWER AND LOW DUTY CYCLE WHILE MONITORING OCCURRENCE OF ANTICIPATED EVENT

(75) Inventors: Wei Ma, San Ramon, CA (US); Ahmad Bahai, Lafayette, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 340 days.

(21) Appl. No.: 11/306,949

(22) Filed: Jan. 17, 2006

(51) Int. Cl.
*G08B 23/00* (2006.01)

(52) U.S. Cl. ..... 340/693.3; 73/861.18

(58) Field of Classification Search ..... 340/693.3, 340/10.5, 825.72; 73/861.18; 367/87, 93; 381/92

See application file for complete search history.

(56) References Cited

U.S. PATENT DOCUMENTS 4,797,664 A * 1/1989 Kimura ..... 340/693.3
5,303,307 A 4/1994 Elko et al.
5,473,684 A 12/1995 Bartlett et al.
5,586,191 A 12/1996 Elko et al.
5,825,413 A 10/1998 Mullis
5,854,720 A * 12/1998 Shrinkle et al. ..... 360/69
6,362,749 B1 * 3/2002 Brill ..... 340/693.3
6,428,469 B1 8/2002 Iddan et al.
6,587,047 B2 * 7/2003 Nilsson et al. ..... 340/693.3
6,764,440 B2 7/2004 Iddan et al.
7,027,416 B1 4/2006 Kriz
7,148,796 B2 * 12/2006 Joy et al. ..... 340/693.3
2001/0015107 A1 * 8/2001 Feller ..... 73/861.27
2004/0078117 A1 * 4/2004 Vanderah et al. ..... 340/693.3
2005/0040961 A1 * 2/2005 Tuttle ..... 340/693.3
2007/0159348 A1 * 7/2007 Kang et al. ..... 340/825.72

* cited by examiner

*Primary Examiner*—John A Tweel, Jr.
(74) *Attorney, Agent, or Firm*—Vedder Price P.C.

(57) ABSTRACT

Active sensor circuitry for operating at low power and a low duty cycle while monitoring for an occurrence of an anticipated event.

11 Claims, 1 Drawing Sheet

ACTIVE SENSOR CIRCUITRY FOR OPERATING AT LOW POWER AND LOW DUTY CYCLE WHILE MONITORING OCCURRENCE OF ANTICIPATED EVENT

BACKGROUND OF THE INVENTION

1. Field of the Invention

The present invention relates to active sensor circuits, and in particular, to active sensor circuits required to operate at low power and low duty cycle.

2. Description of the Related Art

With recent advancements in semiconductor manufacturing and sensor technologies, low power sensor networks, particularly those operating wirelessly, are providing new capabilities for monitoring various environments and controlling various processes associated with or within such environments. Applications, both civil and military, include transportation, manufacturing, biomedical, environmental management, and safety and security systems.

Particularly for wireless sensor networks, low power operation is critical to allow for maximum flexibility and minimum form factor. It has been found that typical wireless sensor assemblies use upwards of 90% of their power merely on environmental or channel monitoring while waiting for the anticipated event(s) to occur. In other words, simply monitoring for the occurrence of an anticipated event requires the expenditure of nearly all available power. This is particularly true for acoustic sensors, which often require significant amounts of power.

This problem has been addressed thus far by having a low power, or "sleep," mode of operation in which the back end of the sensor assembly, e.g., the signal transmitter, or "radio," circuitry, is effectively shut down pending receipt of a signal indicating the occurrence of the anticipated event (e.g., a change in the local environmental conditions, such as acoustic noise or temperature). This can reduce power consumption of the sensor assembly to levels in the range of 10 to 50 percent of normal, or full power, operation. However, for a low duty cycle system where each sensor assembly may only spend a very small amount of time (e.g., 1%) performing data transmission, the power being consumed during such an idle period can still constitute a major portion of the overall power budget.

SUMMARY OF THE INVENTION

In accordance with the presently claimed invention, active sensor circuitry is provided for operating at low power and a low duty cycle while monitoring for an occurrence of an anticipated event.

In accordance with one embodiment of the presently claimed invention, active sensor circuitry for operating at low power and a low duty cycle while monitoring for an occurrence of an anticipated event includes early event detection circuitry and control circuitry. The early event detection circuitry is responsive to external environmental stimuli by providing a corresponding detected signal indicative of whether at least a portion of the stimuli is related to an anticipated event, and includes: a transducer responsive to the stimuli by providing a corresponding transducer signal; and detection circuitry coupled to the transducer and responsive to the transducer signal by providing the detected signal. The control circuitry is coupled to the early event detection circuitry and responsive to the detected signal by providing one or more control signals to control operation of downstream circuitry for further processing of the initial processed signal.

In accordance with another embodiment of the presently claimed invention, active sensor circuitry for operating at low power and a low duty cycle while monitoring for an occurrence of an anticipated event includes early event detector means and controller means. The early event detector means is for receiving external environmental stimuli and in response thereto providing a corresponding detected signal indicative of whether at least a portion of the stimuli is related to an anticipated event, and includes: transducer means for receiving the stimuli and in response thereto providing a corresponding transducer signal; and detector means for receiving the transducer signal and in response thereto providing the detected signal. The controller means is for receiving the detected signal and in response thereto providing one or more control signals to control operation of downstream circuitry for further processing of the initial processed signal.

DETAILED DESCRIPTION

Figure 1:
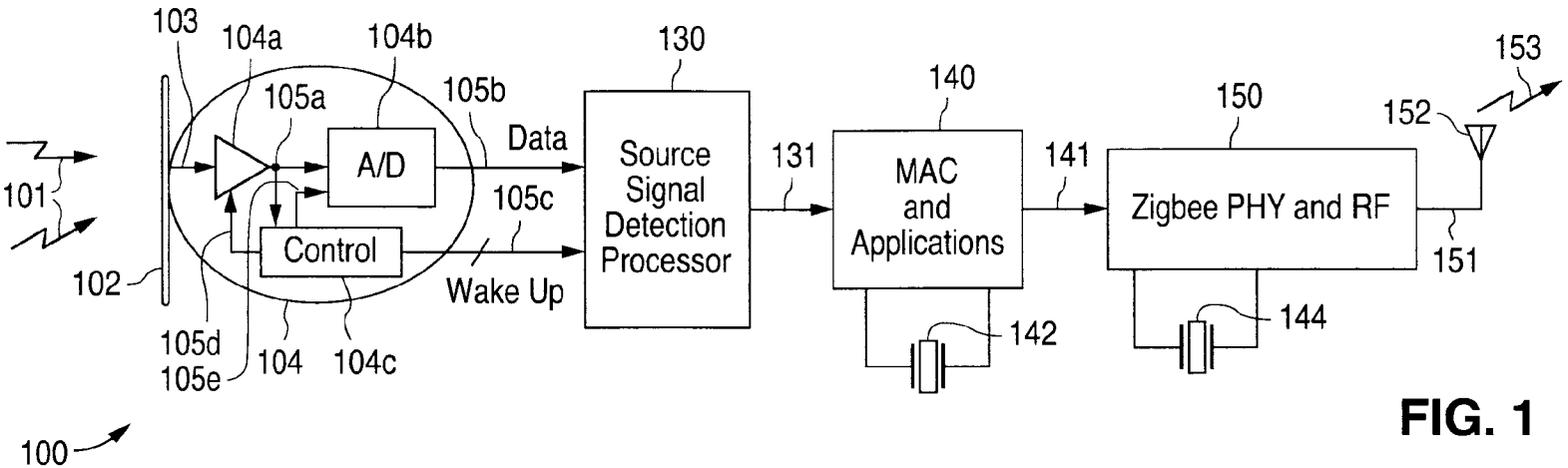
FIG. 1 is a system functional block diagram of active sensor circuitry for operating at low power and low duty cycle while monitoring for an occurrence of an anticipated event in accordance with one embodiment of the presently claimed invention.

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed.

Referring to the figure, active sensor circuitry in accordance with one embodiment of the presently claimed invention includes early event detection circuitry with a transducer 102 and detection circuitry 104, detection signal processing circuitry 130, and signal transmission circuitry with media access control (MAC) circuitry 140 and interface circuitry 150 (e.g., providing the physical layer and wireless signal transmission interfaces). Additionally, in the case of a wireless sensor system, an antenna 152 is included.

During most of its operational life, the system 100 operates such that the early event detection circuitry 102, 104 is provided with and consumes a predetermined minimal power, while the downstream processing and interface circuits 130, 140, 150, are effectively shut down with approximately zero power consumption. As the early event detection circuitry 102, 104 monitors the external stimuli via the transducer 102, internal signal classification and control circuitry 104*c* monitors the intermediate signal 105*a*. Upon reception of external stimuli 101 indicative of an occurrence of the anticipated event, the intermediate signal 105*a* is indicative of such event, and the control circuitry 104*c* provides control signals 105*c*, 105*d*, 105*e* to the downstream processing circuitry 130, amplifier 104*a* and ADC 104*b*. The amplifier control signal 105*d* controls the gain of the amplifier 104*a* as necessary to ensure adequate strength of the intermediate signal 105*a*. The ADC control signal 105*e* controls the ADC 104*b* as necessary to ensure proper conversion of the analog intermediate signal 105*a* to the digital detected signal 105*b*. The downstream control signal 105*c* initiates a turn-on, or "wake-up", sequence of events within the downstream circuits 130, 140, 150 for processing and possible transmission of one or more data signals related to the detected signal 105*b*. The downstream processing circuitry 130 performs the primary signal detection and processing operations, typically using a microprocessor, digital signal processor (DSP), or one or more dedicated application specific integrated circuits (ASICs). This helps ensure accurate detection of events, thereby minimizing signal throughput in the form of unnecessary signal transmissions when occurrences of events have been erroneously detected.

In accordance with one embodiment, the signal classification and control circuitry 104*c* monitors and classifies the low power intermediate signal 105*a* (e.g., corresponding to acoustic or vibration energy) and computes the signal energy to adjust the gain of the amplifier 104*a* to decide if the signal 105*a* indicates the occurrence of an anticipated event. For example, a simple classification can be made based upon an energy threshold. Alternatively, more complex analog classifications can also be made. If the occurrence of an anticipated event is indicated, the classifier would provide the appropriate control signals 105*c*, 105*e* to enable downstream processing to perform more processing for making a more accurate decision.

During most of its operational life, the system 100 operates such that the early event detection circuitry 102, 104 is provided with and consumes a predetermined minimal power, while the downstream processing and interface circuits 130, 140, 150, are effectively shut down with approximately zero power consumption. As the early event detection circuitry 102, 104 monitors the external stimuli via the transducer 102, internal signal classification and control circuitry 104*c* monitors the intermediate signal 105*a*. Upon reception of external stimuli 101 indicative of an occurrence of the anticipated event, the intermediate signal 105*a* is indicative of such event, and the control circuitry 104*c* provides control signals 105*c*, 105*d*, 105*e* to the downstream processing circuitry 130, amplifier 104*a* and ADC 104*b*. The amplifier control signal 105*d* controls the gain of the amplifier 104*a* as necessary to ensure adequate strength of the intermediate signal 105*a*. The ADC control signal 105*e* controls the ADC 104*b* as necessary to ensure proper conversion of the analog intermediate signal 105*a* to the digital detected signal 105*b*. The downstream control signal 105*c* initiates a turn-on, or "wake-up", sequence of events within the downstream circuits 130, 140, 150 for processing and possible transmission of one or more data signals related to the detected signal 105*b*. The downstream processing circuitry 130 performs the primary signal detection and processing operations, typically using a microprocessor, digital signal processor (DSP), or one or more dedicated application specific integrated circuits (ASICs). This helps ensure accurate detection of events, thereby minimizing signal throughput in the form of unnecessary signal transmissions when occurrences of events have been erroneously detected.

Figure 2:
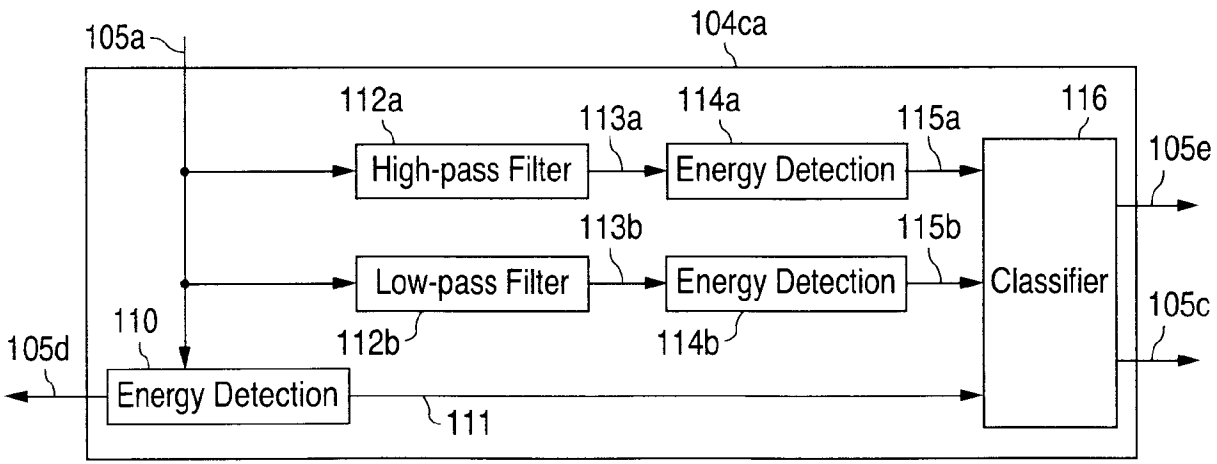
FIG. 2 is a functional block diagram of the signal classification and control circuitry of FIG. 1.

Referring to FIG. 2, in accordance with another embodiment, the signal classification and control circuitry 104*ca* can provide more accurate detection than that of simple energy detection with energy detection circuits 110, 114*a*, 114*b*, filters 112*a*, 112*b*, and signal classifier circuitry 116. The energy of the intermediate signal 105*a* is detected by an energy detection circuit 110 which provides the amplifier control signal 105*d* and a detected signal 111 which is provided to the signal classifier circuitry 116. The energy of the intermediate signal 105*a* is also filtered by high pass 112*a* and low pass 112*b* filters. The respective energies of the filtered signals 113*a*, 113*b* are detected by energy detection circuits 114*a*, 114*b*, which provide the resultant signals 115*a*, 115*b* to the signal classifier circuitry 116. The signal classifier circuitry 116 processes (e.g., compares the relative magnitudes) these signals 111, 115*a*, 115*b* to determine whether an anticipated event has occurred. In the event that it is determined, by the signal classifier circuitry 116, that an anticipated event has occurred, the additional control signals 105*c*, 105*e* are asserted as discussed above.

For example, for mechanical vibrations, the low frequency band energy is significantly larger than the high frequency band energy. If the anticipated event is a vibration, the system can turn on more accurately than simple average energy detection. The filters 112*a*, 112*b* can be easily implemented in low power analog circuits, which typically minimizes the system power needed. Further, the two bands (high pass and low pass) can be expanded to multiple bands or more specific band pass filters to achieve better performance for signals related to different anticipated events.

Referring to FIG. 3, in accordance with another embodiment, the signal classification and control circuitry 104*c* can provide more accurate detection than that of simple energy detection with energy detection circuits 110, 114*a*, 114*b*, filters 112*a*, 112*b*, and signal classifier circuitry 116. The energy of the intermediate signal 105*a* is detected by an energy detection circuit 110 which provides the amplifier control signal 105*d* and a detected signal 111 which is provided to the signal classifier circuitry 116. The energy of the intermediate signal 105*a* is also filtered by high pass 112*a* and low pass 112*b* filters. The respective energies of the filtered signals 113*a*, 113*b* are detected by energy detection circuits 114*a*, 114*b*, which provide the resultant signals 115*a*, 115*b* to the signal classifier circuitry 116. The signal classifier circuitry 116 processes (e.g., compares the relative magnitudes) these signals 111, 115*a*, 115*b* to determine whether an anticipated event has occurred. In the event that it is determined, by the signal classifier circuitry 116, that an anticipated event has occurred, the additional control signals 105*c*, 105*e* are asserted as discussed above.

For example, for mechanical vibrations, the low frequency band energy is significantly larger than the high frequency band energy. If the anticipated event is a vibration, the system can turn on more accurately than simple average energy detection. The filters 112*a*, 112*b* can be easy implemented in low power analog circuits, which typically minimizes the system power needed. Further, the two bands (high pass and low pass) can be expanded to multiple bands or more specific band pass filters to achieve better performance for signals related to different anticipated events.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including active sensor circuitry for operating at low power and a low duty cycle while monitoring for an occurrence of an anticipated event, comprising:

early event detection circuitry responsive to external environmental stimuli and one or more control signals by providing a corresponding detected data signal indicative of whether at least a portion of said stimuli is related to an anticipated event, and including a transducer responsive to said stimuli by providing a corresponding transducer signal, and detection circuitry coupled to said transducer and responsive to said transducer signal and at least one of said one or more control signals by providing an intermediate signal and said detected data signal; and control circuitry coupled to said early event detection circuitry and responsive to said intermediate signal by providing said one or more control signals.

2. The apparatus of claim 1, wherein:

an assertion of said detected data signal is indicative of an occurrence of an anticipated event;

a de-assertion of said detected data signal is indicative of a non-occurrence of said anticipated event; and said active sensor circuitry is operative in a plurality of operation modes, including higher and lower power modes in response to said assertion and de-assertion, respectively, of said detected data signal.

3. The apparatus of claim 1, wherein said detection circuitry comprises amplifier circuitry responsive to at least said transducer signal by providing said intermediate signal.

4. The apparatus of claim 3, wherein said detection circuitry further comprises analog-to-digital conversion circuitry coupled to said amplifier circuitry and responsive to at least one of said one or more control signals and said intermediate signal by providing said detected data signal.

5. The apparatus of claim 1, further comprising detection signal processing circuitry coupled to said early event detection circuitry and said control circuitry, and responsive to said detected data signal and at least one of said one or more control signals by selectively providing a processed data signal representing said anticipated event.

6. The apparatus of claim 5, further comprising data signal transmission circuitry coupled to said detection signal processing circuitry and responsive to said processed data signal by providing a corresponding data transmission signal for transmission to a remote data signal receiver.

7. The apparatus of claim 5, further comprising data signal transmission circuitry coupled to said control circuitry and said detection signal processing circuitry, and responsive to at least one of said one or more control signals and said processed data signal by providing a corresponding data transmission signal for transmission to a remote data signal receiver.

8. The apparatus of claim 1, wherein said control circuitry comprises:

first energy detection circuitry responsive to said intermediate signal by providing at least one detected energy signal;

second energy detection circuitry responsive to said intermediate signal by providing at least another detected energy signal and at least a first one of said one or more control signals; and classification circuitry coupled to said first and second energy detection circuitries, and responsive to said at least one detected energy signal and said at least another detected energy signal by providing at least a second one of said one or more control signals.

9. The apparatus of claim 8, wherein:

said first energy detection circuitry comprises higher frequency energy detection circuitry responsive to said intermediate signal by providing a first detected energy signal as one of said at least one detected energy signal, and lower frequency energy detection circuitry responsive to said intermediate signal by providing a second detected energy signal as another of said at least one detected energy signal; and said second energy detection circuitry comprises average frequency energy detection circuitry responsive to said intermediate signal by providing a third detected energy signal as said at least another detected energy signal.

10. The apparatus of claim 9, wherein:

said higher frequency energy detection circuitry comprises high pass filter circuitry responsive to said intermediate signal by providing a first filtered signal, and first signal detection circuitry coupled to said high pass filter circuitry and responsive to said first filtered signal by providing said first detected energy signal; and said lower frequency energy detection circuitry comprises low pass filter circuitry responsive to said intermediate signal by providing a second filtered signal, and second signal detection circuitry coupled to said low pass filter circuitry and responsive to said second filtered signal by providing said second detected energy signal.

11. An apparatus including active sensor circuitry for operating at low power and a low duty cycle while monitoring for an occurrence of an anticipated event, comprising:

early event detector means for receiving external environmental stimuli and one or more control signals, and in response thereto providing a corresponding detected data signal indicative of whether at least a portion of said stimuli is related to an anticipated event, and including transducer means for receiving said stimuli and in response thereto providing a corresponding transducer signal, and detector means for receiving said transducer signal and at least one of said one or more control signals, and in response thereto providing an intermediate signal and said detected data signal; and controller means for receiving said intermediate signal and in response thereto providing said one or more control signals.

* * * * *